United States Patent [19]

Gravenhorst

[11] Patent Number: 4,950,125

[45] Date of Patent: Aug. 21, 1990

[54] "TRUE FREE FALL" HYDRAULIC WINCH SYSTEM FOR CONVERTING A "BACKHOE" TO A "CRANE"

[75] Inventor: Richard L. Gravenhorst, River Ridge, La.

[73] Assignee: Reco Crane Company, Inc., New Orleans, La.

[21] Appl. No.: 944,421

[22] Filed: Dec. 19, 1986

[51] Int. Cl.[5] ..... B66C 23/36

[52] U.S. Cl. ..... 414/569; 254/379

[58] Field of Search ..... 414/569; 254/326, 327, 254/361, 378, 379; 37/115; 212/255, 260, 232

[56] References Cited

U.S. PATENT DOCUMENTS

| | | | |
|---|---|---|---|
| 3,247,606 | 4/1966 | Page | 37/115 X |
| 3,378,158 | 4/1968 | Lopez | 254/361 X |
| 3,541,710 | 11/1970 | Sankey et al. | 37/115 |
| 3,593,866 | 7/1971 | Gazdarica | 414/569 |
| 3,776,513 | 12/1973 | Mosley | 254/379 X |
| 3,874,532 | 4/1975 | Metailler | 414/569 X |
| 3,934,729 | 1/1976 | Wellman | 254/326 X |
| 3,994,476 | 11/1976 | Van Gennep | 254/378 X |
| 4,277,053 | 7/1981 | Simon | 254/326 |
| 4,627,519 | 12/1986 | Larsen et al. | 254/379 X |

OTHER PUBLICATIONS

MRH-95 MRH 2/3-95 Bulletin No. 09581, KYB Corp. of American, pp. 1-8.

MA125U STV Amphibious Soft Terrain Vehicle Specifications, Hitachi, Hydraulic Excavator Competitive Comparison, FMC.

Link-Belt Cranes, Excavators and Diesel Pile Hammers, FMC, pp. 1-20

Components-Model PD15 (Material List), pp. 10-11.

Link-Belt Hydraulic Excavator LS-2800B, FMC Corporation, 3/85, pp. 1-6.

Link-Belt Crane and Excavator Product Line Guide, FMC Corp., 5/84, pp. 1-18.

Link-Belt Hydraulic Feller Buncher LS-2800FB, FMC Corp., 3/86, pp. 1-2.

Link-Belt Hydraulic Excavator LS-2800B, FMC Corp., 3/85, pp. 1-6.

Link-Belt LS-78 Wire Rope Crawler Excavator/-Crane, FMC Corp., pp. 1-8.

Link-Belt LS-5800TL Hydraulic Crawler Logging Crane, FMC Corp., pp. 1-6.

Link-Belt LS-5800SL Hydraulic Crawler Scrap Crane, FMC Corp., pp. 1-4.

Designer's Guide for Viking Motors, Publication 85-0-2-01/Edition 1, 1985, pp. 1-68.

*Primary Examiner*—David A. Bucci

*Attorney, Agent, or Firm*—C. Emmett Pugh

[57] ABSTRACT

A conversion backhoe-to-crane type system, including preferably a box type, 50' boom and two, hydraulically driven cable or line winches, the hoist one of which is mounted directly on the crane-like boom. The winches have "true free fall" characteristics, by using a high torque, radial piston hydraulic motor directly driving the drum, which motor can be put into a "neutral" disposition, exerting no significant drag on the cable winch drum when it unwinds under the force of the suspended load and/or work implement falling under the force of gravity. Additionally, a supplemental braking system, e.g. a disc brake carried on the winch drum shaft, is added. Thus, the winch drum becomes truly free wheeling, when the hydraulic winch is put in "neutral," but can still be controlled, when desired, by the supplemental disc brake sub-system. A second, spring apply, disc brake is included for emergency back-up. For exemplary purposes, the backhoe conversion is illustrated in a dragline configuration (FIG. 1), but the invention is applicable to providing in a "backhoe" other converted "crane" configurations, e.g. a lift crane (FIG. 9), a clamshell digger or loader (FIG. 10), or a pile driver (FIG. 11), etc. In the conversion the box boom is mounted in place of the standard backhoe type boom, with the supplemental winch mounted on the main body of the backhoe. Alternatively, the winching system of the invention can be used on hydraulic cranes generally to achieve regular, operational "true free fall" for the load.

8 Claims, 7 Drawing Sheets

"TRUE FREE FALL" HYDRAULIC WINCH SYSTEM FOR CONVERTING A "BACKHOE" TO A "CRANE"

BACKGROUND OF INVENTION

1. Fields of Invention

The present invention relates to hydraulic winching systems for hydraulic backhoes and the like, and more particularly to a conversion system for such vehicles, which with the conversion of the present invention use a boom and winch line sub-system that allows the "backhoe" to be used in operations such as draglines, lift cranes, clamshell diggers or loaders, pile drivers, etc.; and even more particularly to such a system in which "true free fall" is achieved on a repetitive, regular, operating basis, when the load and/or work implement being carried by the boom is allowed to freely descend under the force of gravity. The present invention also relates to the providing of a combined boom/-winch system as an accessory piece of equipment for backhoe vehicles and the like, to convert them into a crane type piece of equipment. Additionally, the present invention relates to an improved hydraulic winch system for cranes and the like which achieves "true free fall" for the load, when desired, on an ongoing, regular operational basis with the use of an hydraulic motor directly driving the winch drum and a supplemental braking system for the winch drum, such as for example a disc brake.

2. Prior Art & General Background

A backhoe type vehicle is well known in the art as a very versatile piece of equipment. Although originally used as an excavator, "backhoes" are also usable alternatively, with the proper accessory equipment, as for example a scrap metal/grapple, a logging-heeler, a logging-grapple, scrap shearer, an hydraulic tree feller buncher, etc. Such backhoes typically have a boom pivotally supported underneath by an angled hydraulic cylinder, with the boom carrying a front, accessory arm, which is pivoted about an upper axis by a top hydraulic cylinder to be moved toward and away from the cab under the operator's control; hence the term "backhoe." Winches generally have not been used on backhoes, and as a general rule backhoes heretofore have not been usable as a crane type piece of equipment.

However, as a separate piece of equipment of a different type, cranes have been well known which can be alternatively configured to be a dragline, a lift crane, a clamshell digger or loader, a pile driver, etc., by appropriately changing the accessory equipment attached to the boom of the crane. Typically, such cranes use a lattice type boom made of lacings and cords, forming an open structure, and use winches usually powered by hydraulic motors of the gearing type, with the hoist winch and the in-haul winch mounted on a common shaft on the main body of the crane. Alternatively, expandable clutches working on the cylindrical interior of a drum are typically use to transmit the power from the main power or prime mover. In either case, for braking of the winch drum, externally contracting band brakes working against the exterior, cylindrical surface of a drum have been typically used to brake the winch.

Thus, in the prior art, to do the jobs the backhoe does best and do the jobs a crane was designed to do, it has been practically necessary to have separately both a backhoe and a crane, resulting in very great expense for the user, with duplication of the crawler (or wheeled) and cab/prime-mover portions of the two pieces of equipment. This very unsatisfactory situation has been with the heavy equipment industry for a long period of time.

The present invention, it is believed, is the first to achieve on a practical, reliable, cost effective, quick-changeover basis, a combined backhoe/crane system embodied in a single piece of main equipment, with the change over from backhoe to crane being achieved with an accessory system, thereby avoiding any substantial duplication of the main equipment, with the equipment achieving "true free fall" for the load when desired on an ongoing, operational basis.

There apparently has been at least one attempt at combining backhoe and crane systems on a combined "backhoe," as indicated by a brochure on the HITACHI MA125U STV amphibious soft terrain vehicle apparently printed in 1982. However, it mounts its two winches side-by-side on the main body of the backhoe and does not mount the hoist winch on the boom itself in the line-of-sight of the operator, as in the preferred embodiments of the invention. Additionally, it apparently uses relatively low torque hydraulic motors for the winches.

Thus, additionally, one of the problems that has persisted in the prior art over a long period of time with hydraulic crane systems, that is ones using hydraulic gearing motors, has been the lack of "true free fall" of the object being carried from the end of the boom by the cable line, when the hydraulic winch lets loose on the hoist line. Thus, usually because of the retarding or dragging action of the hydraulic winch gearing elements, the object being carried by the cable line is slowed down in its descent under the force of gravity.

Typically, hydraulic winches of the hydraulic gear type have a relatively low torque, for example 200 foot/pounds, requiring that they be torqued up to drive a winch for the loads encountered in cranes. Such reduction gearing usually involves a ratio of the order of 20:1 and uses planetary gearing, including for example input sun gear, secondary sun gear, primary planet gear, secondary planet gear, ring gear, output planet gear, etc.; note for example the PD15 hydraulic winch manufactured by Braden Winch Co. of Broken Arrow, OK, which is used on hydraulic cranes for hoist lines and the like. When the hydraulic motor is cut off to allow the hoist cable to "freely" spool out, the reduction, planetary gearing still is being rotated, producing significant retardation or drag on the line.

Although some manufacturers claim "free fall" characteristics for its released hoist line, when the hydraulic gear motor has been cut off, such has been meant in the prior art only as a relative term, and it is believed that "true free fall," which allows the load or work implement at the end of the cable to freely move under the force of gravity without any significant retardation or drag, has not been achieved in such a system on a regular, operational, repetitive basis until the present invention.

As an indicator of the difference in the "free fall" characteristics of the prior art hydraulic gear motor compared to that used in the exemplary preferred embodiment of the present invention, the former takes of the order of a 1,500 lb. minimum load to initiate spooling out of the hoist line in "free fall," while the present invention in the initial prototype required only approximately 150 lb. minimum load.

Additionally, it should be understood that the so-called "emergency" subsystem, which is provided in some prior art hydraulic cranes as a safety factor, which allows a load to be quickly dropped to prevent for example tip over of the crane due to imbalance, is just that, namely a one-time-usage, emergency system, analogous to the safety "seat ejector" in an airplane. In one such "emergency" system, a pin connecting the reduction gearing to the drum is pulled, allowing the drum to then to "truly" freely rotate without the supplemental gearing. However, if the motor is attempted to be "re-engaged" before the pin is properly reassembled, the motor train can be substantially damaged. Additionally, the operator loses all control over the hoist line and its load, once the "emergency" button is actuated.

In contrast, the present invention achieves "true free fall" on a repetitive, regular operational basis, every time it is desired to have the load or working implement suspended from the cable off of the boom to freely fall or drop under the force of gravity. Such action allows, not only emergency use, but repetitive use to speed up the operation at hand on a regular operational basis, since no unnecessary time is lost due to delayed load or implement movement.

In the preferred embodiments the invention achieves these long desired, advantageous goals by utilizing a high torque hydraulic motor directly driving the winch drum, that is without any supplemental, interconnecting gearing, and a supplemental braking system, preferably a disc brake system. Although there have been prior attempts to combine an hydraulic, high torque motor to directly drive winches (see Hagglunds' Viking Motors for very large crane winches and the like, and the "HYDROSTAR" MRH 95 & 2/3-95 apparently used on a trawl winch), none it is believed were part of a backhoe-to-crane conversion system, but rather a regular crane or trawl winch installation, and additionally used, to the extent known, the standard, old type of externally contracting band brake, in comparison to the disc type brake of the preferred embodiment.

Thus, in summary, the present invention allows a backhoe to be quickly and easily converted to a crane type piece of equipment, with preferably at least part of the winching system being included on the boom itself, and with the winching system being capable of "true free fall" by preferably using a high torque hydraulic motor directly driving the drum winch with a supplemental brake system being provided, preferably of the disc brake type. Such an achievement allows the converted crane "backhoe" type vehicle adapted with the present invention to operate much more quickly and safely, in comparison to those of the prior art, without having any substantial duplication of heavy, expensive equipment.

GENERAL, SUMMARY DISCUSSION OF THE INVENTION

Thus, the present invention in its primary aspect is directed to an improved accessory or sub-system for use on or with backhoe type vehicles and the like to quickly and easily convert them to a crane type piece of equipment, in which at least the hoist winch includes an hydraulic powered motor which can be put into a "neutral" non-retarding disposition, and in which there is further provided a supplemental braking system for controlling, as desired, the cable movement independently of the hydraulics of the winch. Such a combination achieves for the first time, it is believed, "true free fall" for such a converted vehicle.

Thus, the present invention achieves this highly desirable characteristic by utilizing a direct drive hydraulic motor for the winch, which can be put in a neutral or neutralized position, that is a disposition which produces no significant drag or retardation on the cable winch drum, when the hoist line is released, and be of a size easily mounted on a backhoe and preferably on the boom itself, and further utilizing a separate, supplemental braking system for the hoist drum, an exemplary such braking system being a disk-type brake, associated with the axle of the winch drum. Thus, when the hoist line is released, no significant retarding drag is put on the released line, allowing the load at the end of the cable to fall freely down under the force of gravity. However, when it is desired to retard or stop the cable from being further played out, the supplemental braking system is actuated to the extent desired.

The system of the present invention is applied to backhoe type vehicles, whether they are needed to be used in a dragline configuration or other such configurations as a lift crane, clamshell digger or loader, or pile driver, etc.

In such configurations, an in-haul, hydraulic winch is also typically used, with the exception of the lift crane configuration, in addition to the hoist winch. The present "true free fall" aspects of the invention are likewise equally and Preferably applied to this winch as well, thereby also providing the in-haul winch with an hydraulic motor that can be put into a true neutralized disposition, along with a supplemental brake system, such as for example a disc brake system, mounted in association with the axle of the winch drum.

Additionally, the boom used with the hydraulic hoist winch system of the present invention is preferably of the box boom type, in contrast to for example a lattice boom with pennant line(s), although the present invention can likewise be applied to a crane type structure having such a lattice boom structure, if desired, with preferably the hoist winch being mounted on the boom itself as a combined structure.

It is thus a basic object of the present invention to provide an hydraulic backhoe type vehicle and the like with crane capabilities on an easy conversion basis, with hydraulically powered winch(es) which allow "true free fall" when released, in such a manner that such "true free fall" is achievable on a repetitive, regular operational basis, and not merely on a one-time "emergency" basis.

It is a further object of the present invention to provide such a system which is reliable, long-lasting and relatively economical in both its original cost and its maintenance costs, and avoids the substantial duplication and substantial expense in having two separate pieces of heavy equipment for backhoe operations and for crane operations.

It is also an object of another aspect of the present invention to provide an hydraulic winch system for cranes generally which achieves "true free fall" on a repetitive, regular operational basis, and not merely on a one-time "emergency" basis and without endangering the winch equipment.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIGS. 2, 3 & 4 are plan, rear and end views, respectively, of the preferred, exemplary embodiment of the winch fabrication assembly of FIG. 1, including both its directly coupled, high torque hydraulic drive motor and its supplemental disc brake system; while

FIG. 6 is an exploded, perspective view of the preferred, exemplary embodiment of the combined, integrated box boom and hoist winch sub-assemblies of the embodiment of FIG. 1; while

DETAILED DESCRIPTION OF THE PREFERRED, EXEMPLARY EMBODIMENTS

Figure 1:
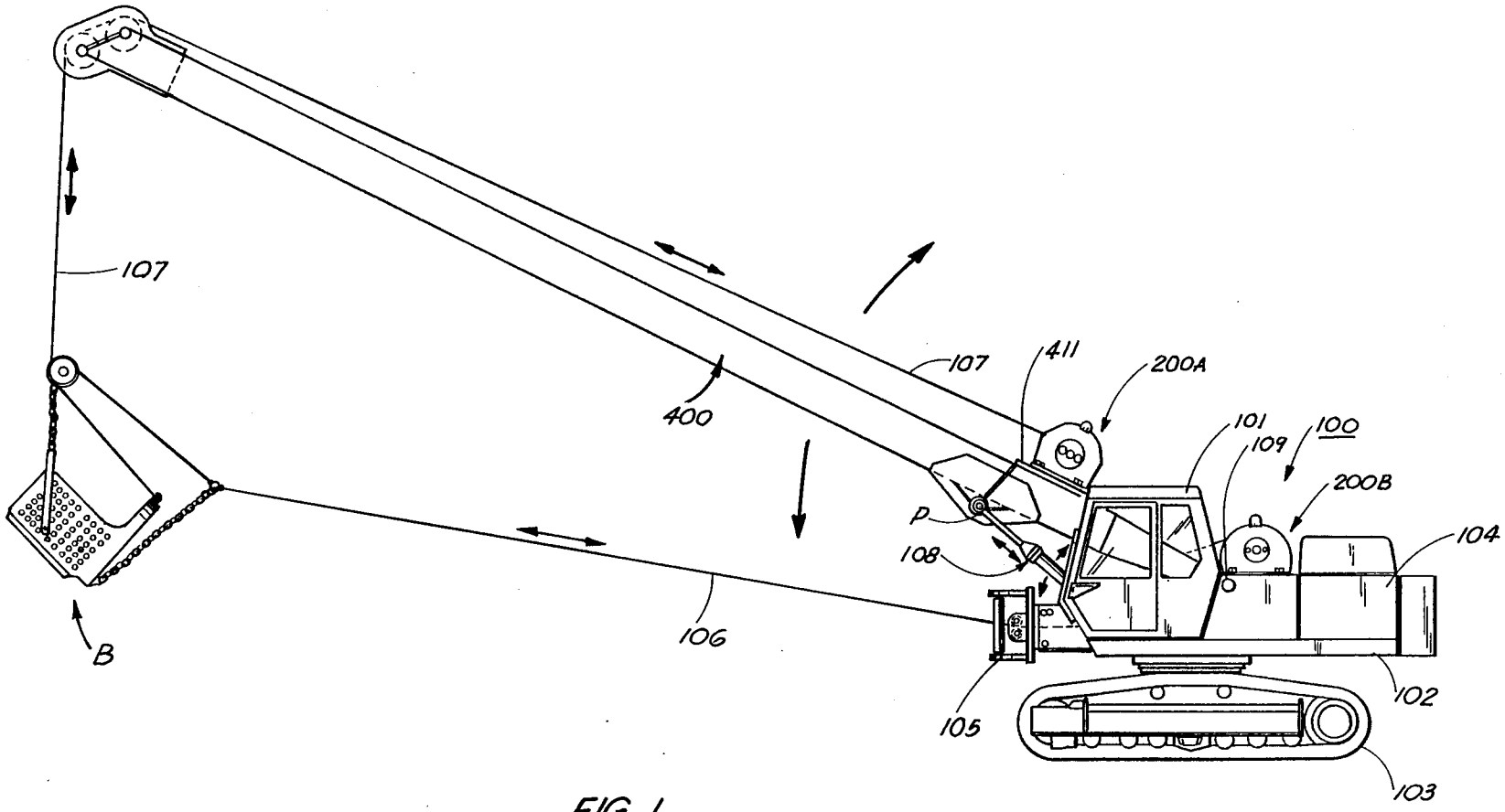
FIG. 1 is a side view of a crawler hydraulic backhoe vehicle onto which the preferred, exemplary embodiments of the boom/winching systems of the present invention have been attached to adopt or convert the backhoe vehicle to serve, for example, as a dragline, with a bucket and hoist cabling sub-system which achieves "true free fall."
Figure 9:
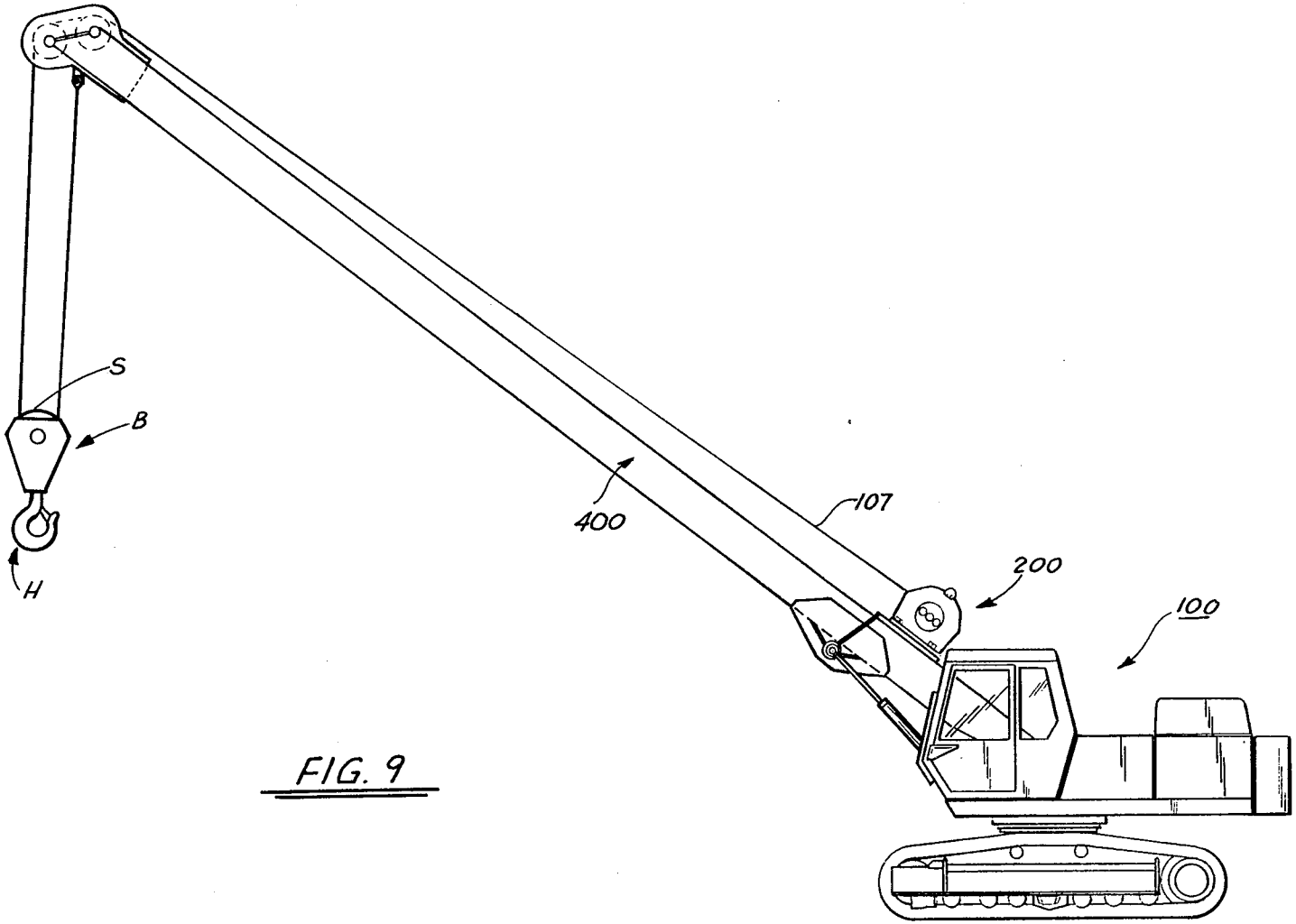
FIG. 9 is a side view of the same crawler hydraulic backhoe vehicle of FIG. 1, onto which the exemplary embodiment of the boom/hoist-winching systems of the present invention has been attached to adopt or convert the backhoe vehicle to serve, for example, as a lift crane, with a lift hook and hoist cabling sub-system which achieves "true free fall."
Figure 10:
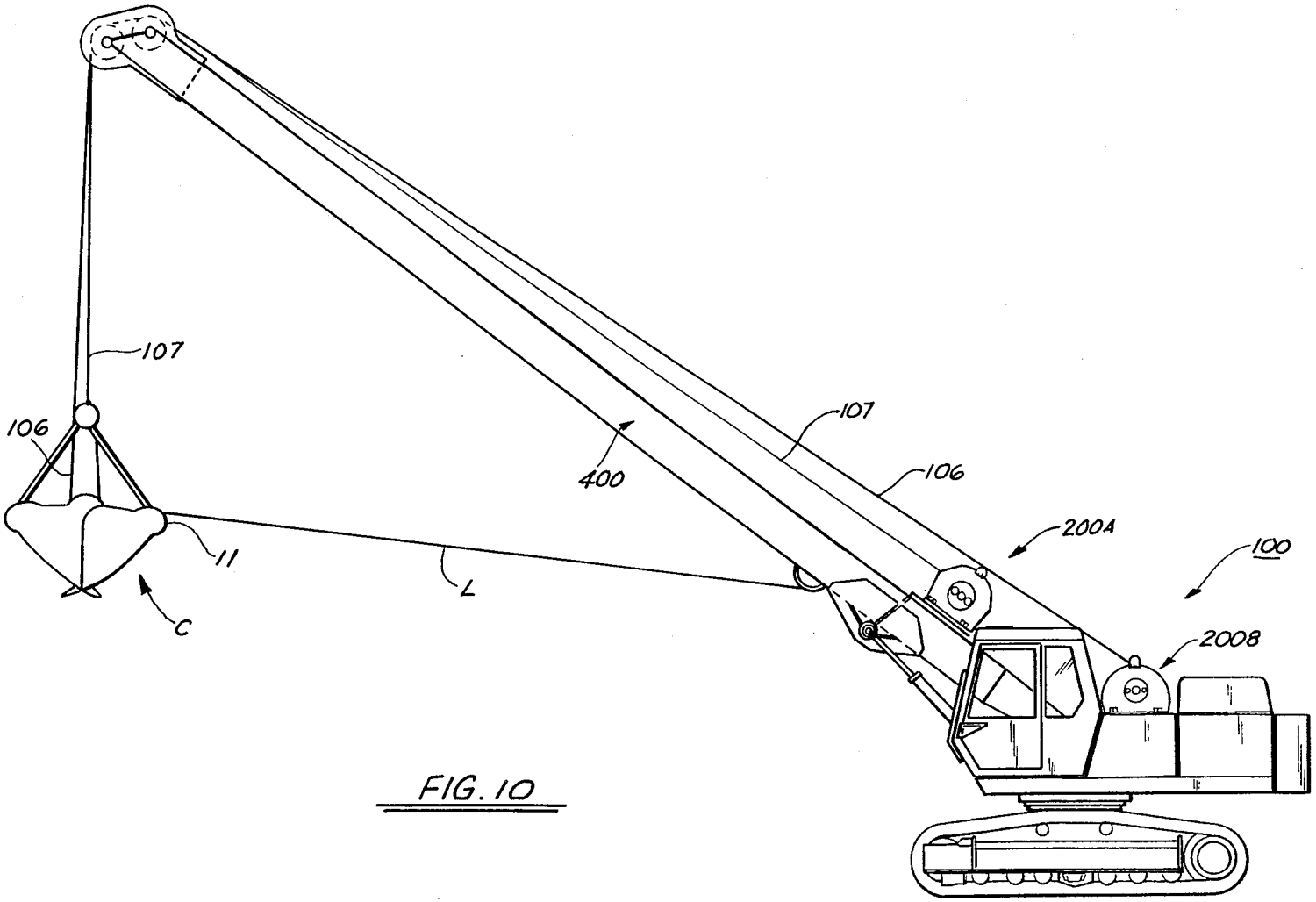
FIG. 10 is a side view of the same crawler hydraulic backhoe vehicle of FIG. 1, onto which the exemplary embodiment of the boom/winching systems of the present invention has been attached to adopt or convert the backhoe vehicle to serve, for example, as a clamshell digger, with a clamshell and hoist cabling sub-system which achieves "true free fall."
Figure 11:
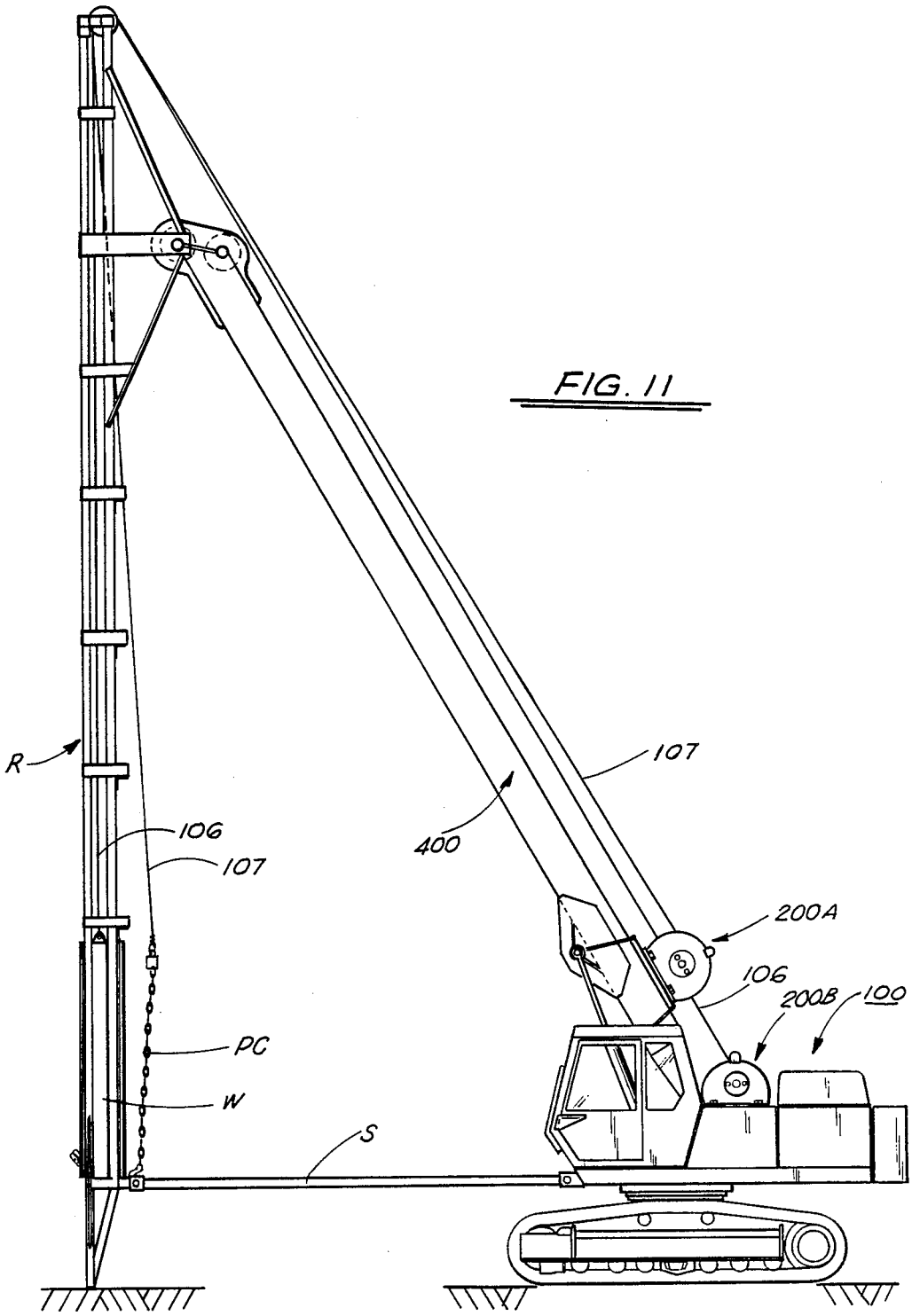
FIG. 11 is a side view of the same crawler hydraulic backhoe vehicle of FIG. 1, onto which a final exemplary embodiment of the boom/winching systems of the present invention has been attached to adopt or convert the backhoe vehicle to serve, for example, as a pile driver, with a pile driver and weight hoist cabling sub-system which achieves "true free fall."

With reference to FIG. 1, a first preferred, exemplary embodiment of the present invention is shown, as applied as an adaptive accessory system for converting a standard crawler, hydraulic backhoe vehicle 100 to work as a dragline. However, it should be understood that, as illustrated in FIGS. 9–11, the present invention is likewise applicable to achieving "true free fall," not only for a dragline configuration, but also for other exemplary backhoe adaptive configurations, such as for example a lift crane, a clamshell, a pile driver, etc.

The exemplary backhoe type vehicle illustrated is an "FMC Link-Belt" backhoe model LS-2800B, having an approximate operating weight of forty thousand pounds, although of course the present invention is likewise adaptable to many other different backhoes and like type vehicles.

As can be seen in FIG. 1, such an exemplary backhoe includes an operator's cab 101 mounted on a base platform 102. The base 102 is mounted on a three hundred and sixty degree turntable on the endless track undercarriage 103 for movement over the ground as desired. Housing 104 contains the main power package for the backhoe, including the main motor or prime mover, hydraulic fluid pump, etc.

Hydraulic boom hoist cylinders 108 (one on each side) extend upwardly from the front of the main body of the backhoe 100 to raise and lower, as desired, whatever boom may be attached by pivot pins to the main foot pivot 109 and the upper ends of the hydraulic cylinders 108, to change the effective angle and/or height of the boom. Typically, a backhoe excavator will include a main boom extending up and out from the backhoe's foot pivot, with the boom having at its distal end an attachment arm designed to do some specific backhoe type work, with the interconnection between the boom and the arm including a further hydraulic cylinder for moving the arm with respect to the boom.

All of the foregoing represents standard backhoe type construction.

As can be seen in FIG. 1, the first exemplary embodiment of the present invention converts a standard backhoe 100 to have dragline, crane capabilities using a standard type dragline bucket B. As is well known in the dragline art, the bucket B is raised by a hoist line, moved to a desired location by moving the crane boom (if necessary), dropped preferably with "true free fall" into the area being dragged out, and then pulled or dragged in toward the operator's cab with an haul-in line, picking up a load in the bucket B.

As will be described more fully below, the conversion structure of the present invention primarily includes the boom 400, the winches 200A, 200B and the fair leader 105. As illustrated in FIG. 1, at the front of the base platform 102 the fair leader structure 105 is included, which swivels or pivots about a horizontal axis and includes a series of vertically and horizontally disposed rollers or sheaves for properly guiding the in-haul line 106 to the in-haul winch 200B.

The preferred, exemplary embodiment of the winching subsystem of the present invention for the dragline configuration of FIG. 1 includes two winches, a hoist winch 200A and the in-haul winch 200B. Both of these winches can have substantially identical structures, the former being used to hoist in and let out the hoist line 107, and the latter to haul in and let out the in-haul line 106 through the fair leader 105 in the embodiment of FIG. 1.

Figure 4:
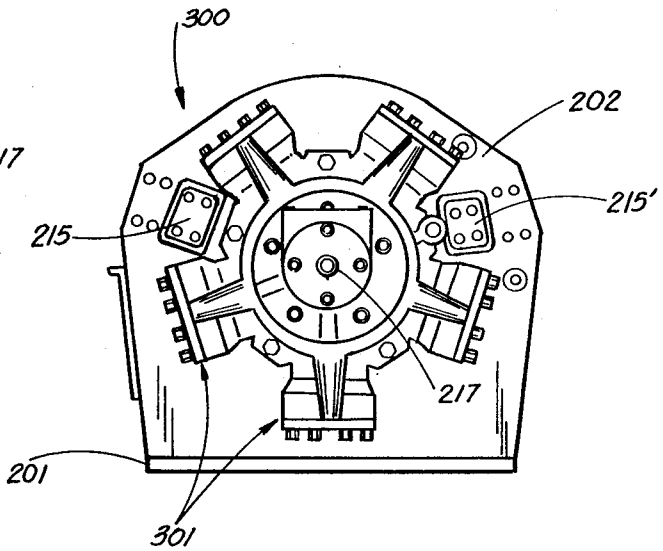
Figure 2:
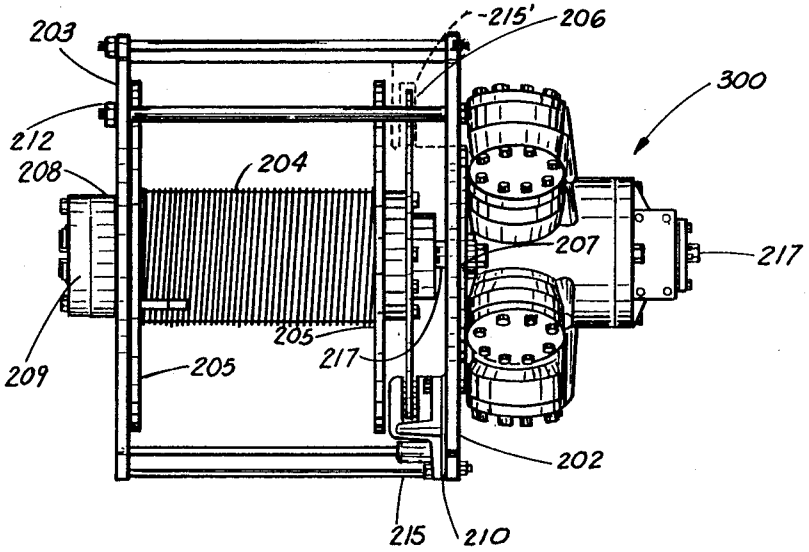
Figure 3:
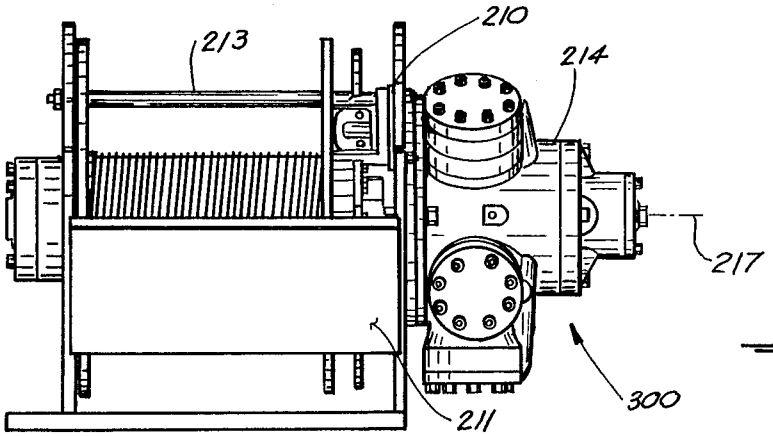

As can best be seen in detail in FIGS. 2–4, the preferred, exemplary embodiment of the "true free fall" winch comprises a drum 204 mounted for rotation about a horizontal axis on axle 217. As can be seen in FIGS. 2 and 3, the outer, exterior surface of the drum 204 is formed with appropriate fluted lagging to position the cable line in a standard, side-by-side disposition when spooled up on the drum.

A radial piston, hydraulic motor 214/300 is included on one side of the drum structure for directly driving the shaft 217, causing the drum to either pull in the cable line or to play it out, depending upon the direction of rotation of the motor.

Mounted co-axially with the drum 204 is a brake disc 206, which passes through or between the caliper elements of the caliper disc brake sub-system 215. This braking sub-system is completely independent of the hydraulic operation of the hydraulic motor 214/300. When it is desired to retard or completely brake, i.e. stop, the winch drum 204 from rotating, the disc caliper sub-system 215 is hydraulically actuated, causing the calipers to clamp down on the side edges of the moving disc 206, in a fashion well known to those familiar with the disc brake technology.

A second, back-up caliper sub-system 215' is mounted for example ninety degrees spaced from the main one on the drum base plate 210 and is identical to the main one except with spring apply. If the hydraulics should go out, the back-up, emergency unit 215' will then be "automatically" applied, due to the spring apply working against the new defunct hydraulic retraction.

An exemplary caliper disc brake, which is used in the motor vehicle art for braking vehicles, such as for example an "eighteen wheeler" trailer truck, is the "MICO" 530 model series sliding caliper with hydraulic apply for the main unit 204 and spring apply for the back-up unit 215. The disc 206 can be made for example of "316" stainless steel.

Figure 5:
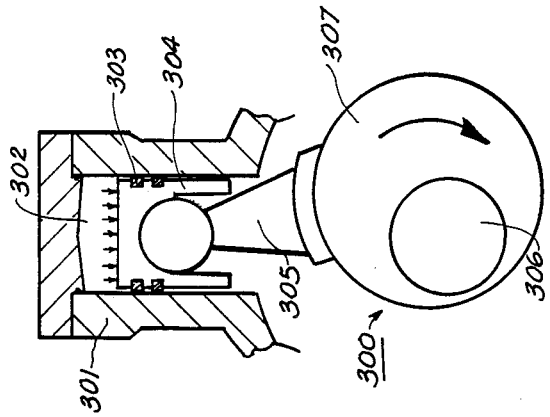
FIG. 5 is an interior, generalized, partial view, showing the internal structure of one of the radial pistons and cam drive mechanism of the preferred, exemplary embodiment of the hydraulic motor.
Figure 6:
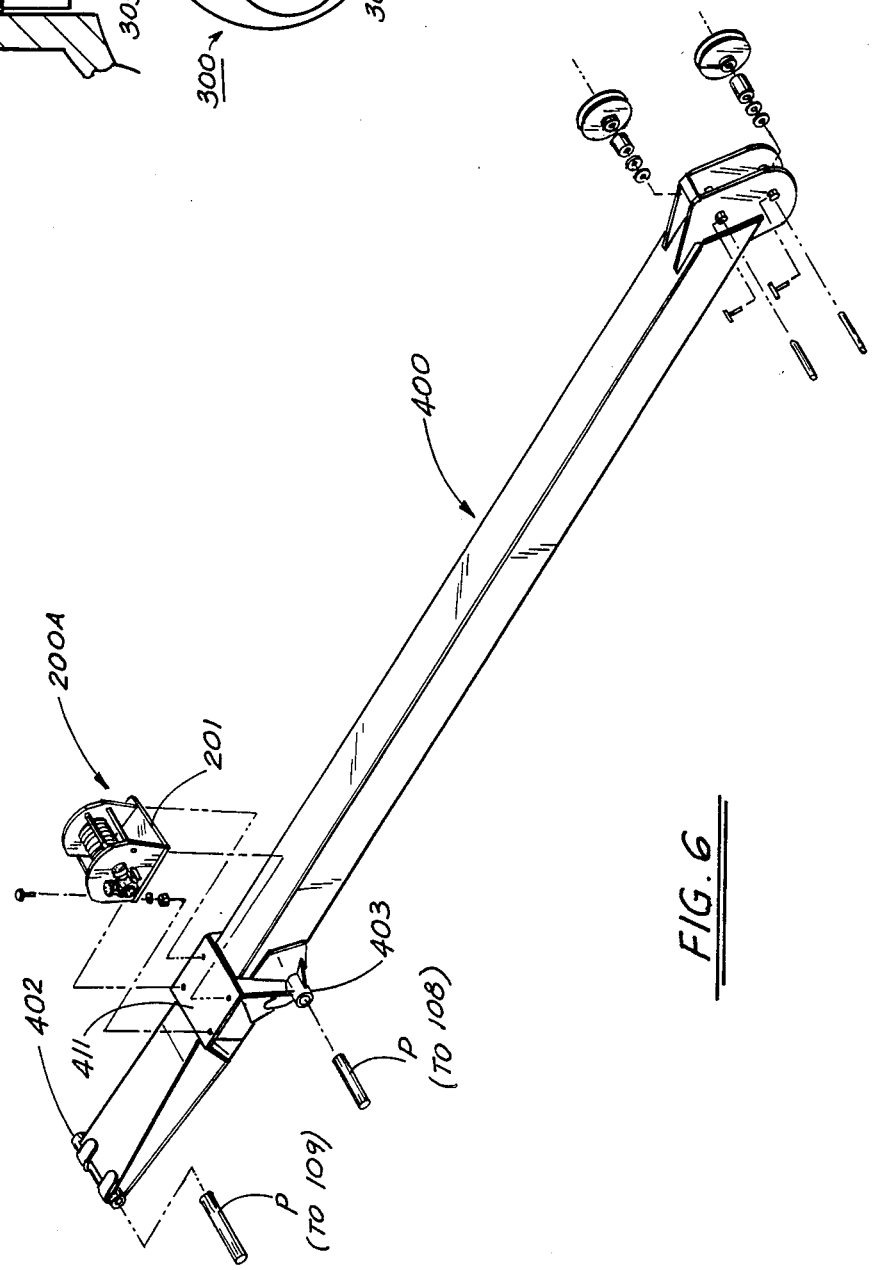
Figure 7:
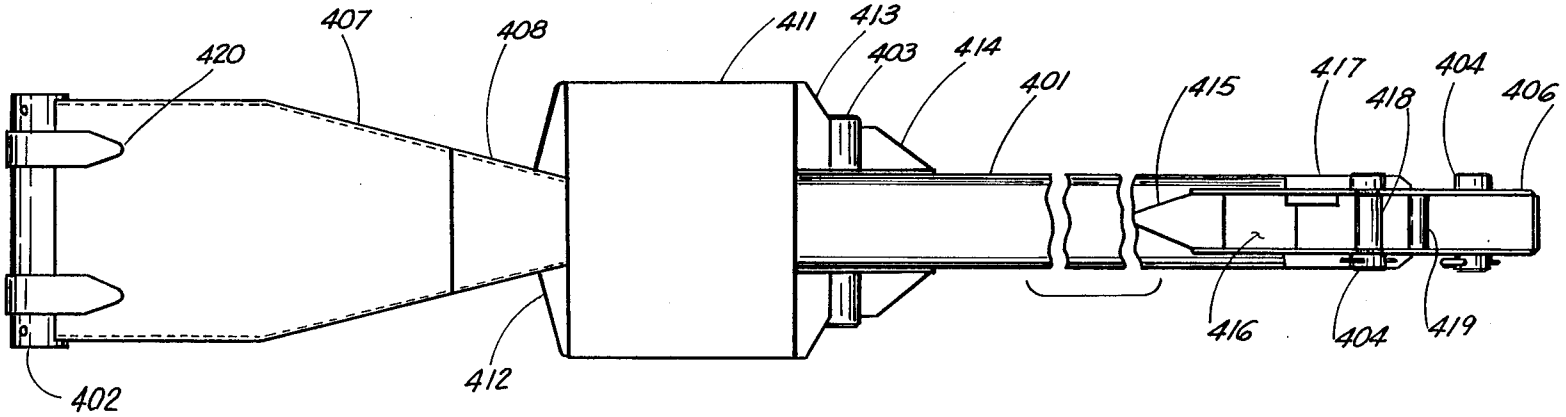
FIGS. 7 and 8 are plan and elevation views, respectively, of the box boom fabrication assembly of the embodiment of FIG. 1.
Figure 8:
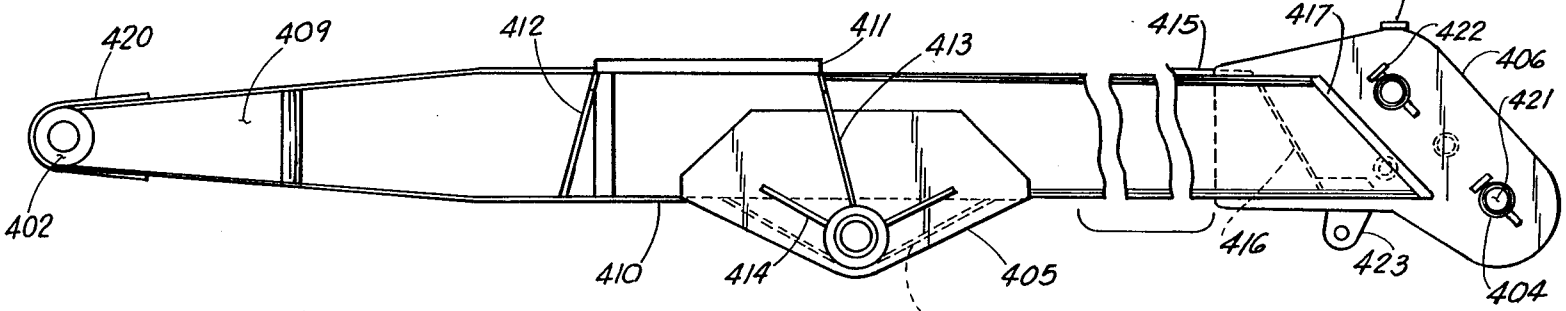

As can best be seen in FIGS. 4 and 5, the hydraulic motor 300 includes a series of five, radially extending, hydraulic cylinders 301, peripherally spaced about the shaft 217 for directly driving the shaft by means of cam connecting rods 305.

With reference to FIG. 5, hydraulic pressure 302 is distributed to each cylinder 301 by a rotary valve (not illustrated) which rotates in conjunction with a crankshaft supplying hydraulic pressure to the power stroke of the pistons 304.

The hydraulic pressure to the cylinder 301 exerts a force (note direction arrows) onto the piston 304 as shown in FIG. 5. The force is transmitted to the ball end of the connecting rod 305. This force on the connecting rod is relayed to the surface area of the cam 307, thus providing the rotary movement to the shaft 306, directly rotating the winch drum 204.

To offer smooth rotation, two or three of the five cylinders 301 are always subject to pressurized fluid. The shaft 306 is directly connected by a splined connection to the drum shaft 217, so that they always rotate together as one.

The cam 307 is interconnected to the shaft 306 by means of internal ported pistons (not illustrated), which are moveable radially and when pressurized by action of the operator by means of an internal port line, are moved out of the shaft 306, "breaking" the interconnection. This is the "neutral" disposition of the cylinders 301, making the shaft 306 freewheeling, so that the radial pistons 304 are static, while the shaft 306 is free to rotate without any significant drag on it from the working elements of the hydraulic motor 300.

In this disposition, there is no significant resistance to the rotation of the axle 217 by the hydraulic motor 300, allowing the shaft to rotate without any significant retarding or dragging action, resulting in "true free fall" for the cable 107 being played out from the drum 204.

This allows the hoist line 107 to be pulled off the winch drum 204 under the weight and force of the load or working implement, for example the dragline bucket B, suspended from the end of the hoist line 107 in a "true free fall" action under the force of gravity.

An exemplary hydraulic motor 300 that has sufficient torque to directly drive the winch is the "HYDROSTAR" low speed, high torque model "MRH 2-95" manufactured by KYB Corporation of America, Lombard, Ill. This motor generates approximately four thousand foot/pounds at the maximum acceptable hydraulic pressure found on most backhoes of three thousand five hundred psi. This is sufficient torque to run the size winches used for the hoist winch 200A and the supplemental winch 200B in the herein described "crane" application configurations.

With reference to FIGS. 5–8, the boom 400, which can be for example at least around forty feet and preferably fifty feet in length, is preferably of the box type, made up of solid side walls forming in cross-section a rectangular box configuration. The hoist winch 200A is preferably mounted on a platform 411 on the boom 400 itself, forming a combined, integrated structure, while the other winch 200B is mounted on the main body of the backhoe 100. Alternatively, of course, the in-haul winch 200B could also be mounted on the boom 400 on an appropriate platform, if so desired, for a completely integrated conversion structure. When mounted on the boom 400 as illustrated, the hoist winch 200A is in the operator's line-of-sight.

Exemplary construction details for the winches 200A/B and the boom 400 are outlined below:

Base plate 201 . . . 1"×26"×28.5"
Motor side plate 202 . . ¾"×26"×30"
Idler side plate 203 . . ¾"×26"×30"
Drum 204 . . . 9¼" O.D.×21" LG.
Drum side plate 205. . . ½"×23.5"×8.5" I.D.
Caliper disc 206 . . . 7/16"×22" O.D.×7⅛" I.D.
Idler bearing flange plate 208
Pin 209. . . 7¼" LG.
Base plate 210 . . . ⅜"×2.5"×6¼"
Reinf. plate 211 . . . ⅜"×10"×23.5"
Threaded rod 212 . . . 26⅜"
Pipe, reinf. 213 . . . ¾"×23"
Boom, struct. tube 401 . 10"×14"×⅜"t
Bushing 402. . . 7"O.D.×3½"I.D.×28⅛" LG.
Bushing 403. . . 7"O.D.×3⅜"I.D.×23" LG.
Bushing 404. . . 4½" O.D.×3⅜" I.D.×2½" LG.
Plate, side reinf 405. . ½"×29"×40"
Plate, sheave side 406 . ½" t
Plate, Top & Bottom 407. ½" PL
Top Plate 408. . . ½"×10 2/4" LG×15¾"×12"
Plate, sides 409 . . . ¼"×13/16"×62⅝"
Plate, bottom 410. . . ½"×15¾"×9⅞"×22½"
Plate,winch mounting 411 1¼"×26"×30"
Plate, gusset 412. . . ½"×14"×9"
Plate, gusset 413. . . ½"×10"×14½"
Plate, gusset 414. . . ½"×4¾"×8⅞"
Plate, reinf. 415. . . ½"×5⅞"×10¾"
Plate, closure 416 . . . ½"×5⅞"×15¾"
Plate, closure 417 . . . ½ PL×2"×19¼"
Plate, reinf. 418 . . . ½"×2"×6½" LG.
Pipe, support 419 . . . 2'×6" LG.
Pipe, Wrap 420 . . . ½"×4"×26"
Pin, sheave 421 . . . 2.993×12" LG.
Pin, keeper 422 . . . ¾"
Padeye, Dead End 423 . . 1" PL
Reinf. Plate 424 . . . ½"×9⅞"×15"

Exemplary alternate "backhoe" to "crane" conversions are illustrated in FIGS. 9–11, including a lift crane configuration, a clamshell digger/loader configuration, and a pile driver configuration, respectively.

As can be seen in FIG. 9, the lift crane "backhoe" 100 includes a lift hook H on a block B carried by the hoist or load line 107. Only one winch 200, the hoist winch, is needed for this configuration. As is known, the block B includes a series of sheaves S, the number of which determines the load lift leverage of the lift crane "backhoe" 100.

As can be seen in FIG. 10, the clamshell "backhoe" 11 includes a clamshell bucket C, to which is connected a tag line L, which keeps the clamshell bucket C from twisting around. Both winch lines 106, 107 go from the winches 200A/B to the clamshell C, one (e.g. 106) used to open the shell and the other 107 to hoist it.

As can be seen in FIG. 11, the pile driver "backhoe" 100 includes a hammer weight W carried within the pile leads or rack R. A stand-off pipe S is used to stabilize and position the bottom of the rack R. As is known, the pile chain PC is wrapped around the top of a pile to be driven, and for example the line 107 and hoist winch 200A is used to raise and position the pile within the rack R under the weight W, after of course the hammer weight W has been raised by the line 106. The hammer weight is then cyclically raised and allowed to free fall down, using the "true free fall" characteristics of the winch 200B, until the pile section has been hammered down into the ground. The process is then repeated for subsequent pile sections, all as is well known in the pile driving art.

When it is desired to convert the backhoe 100 from its usual excavator configuration to one of the "crane" configurations of the invention, the standard boom and its arm attachment are unpinned from the foot pivot 109 on the main body of the backhoe 100 and from the upper end of the hydraulic hoist cylinder 108. This process involves only four pins, two pins P on one side being illustrated in FIG. 6.

The boom 400 with its hoist winch 200A mounted on it is then substituted for the standard backhoe boom and attachment arm and pinned into place with the pins P to the foot pivot 109 and the hoist cylinder 108. If needed, the second winch 200B is mounted on the main body of the backhoe 100, the appropriate crane related elements added (e.g. bucket B or block-and-hook B/H or clamshell C or rack-and-weight R/W, etc.), and the lines 106 & 107 appropriately run and connected. The quick conversion is now complete, and the "backhoe" is ready to go to work as a "crane" type piece of equipment, with the winches having "true free fall" capabilities.

With respect to some exemplary variations, it is noted that the supplemental, independent braking system could be designed to operate on the cable itself, although having it operate on one of the operative elements of the winch itself, namely the drum or its shaft or the shaft of the hydraulic motor or the interconnections between the two shafts, and even more preferrably the drum shaft as illustrated, is currently preferred.

The embodiments described herein in detail for exemplary purposes are of course subject to many different variations in structure, design, application and methodology. Because many varying and different embodiments may be made within the scope of the inventive concepts herein taught, and because many modifications may be made in the embodiments herein detailed in accordance with the descriptive requirements of the law, it is to be understood that the details herein are to be interpreted as illustrative and not in a limiting sense.

What is claimed is:

1. A conversion system, including a hydraulically powered winching system and a crane-type boom, for converting a backhoe vehicle operated by a backhoe operator to crane-like operations, which backhoe includes a front end to which a standard backhoe type boom having a forward end and a distal end is pivotally connected and at least one boom hoist hydraulic cylinder, whose lower end is connected to the lower front of the backhoe and whose upper end is connected to said standard backhoe type boom, which winching system controls a hoisting cable on the converted backhoe for suspending a crane-type work implement on the cable, such a work implement being for example, a dragline bucket, lift hook, clamshell, or pile driver, comprising:

a hoist winch drum on which the hoist cable is wound;

a hoist winch drum base upon which said drum is mounted, the mounting of said drum on said base allowing said drum to rotate with respect to said base;

a crane-type boom associated with said base, with said base and said boom having a fixed, constant, longitudinal separation distance during winch operation, said boom having a boom foot with foot pivot connection means for pivotally connecting said boom foot to the front end of the backhoe where the standard backhoe type boom is connected, and intermediate, hoist hydraulic cylinder connection means for connecting said boom to the upper end(s) of the backhoe hoist hydraulic cylinder(s), over which boom the cable is suspended for supporting a crane-type work implement at said distal end of said boom;

hydraulic motor means connected to said drum for directly driving and rotating said drum in two alternative directions of rotation to wind up and play out the cable, depending upon the direction of rotation under the control of said backhoe operator, said motor having a neutral disposition in which no significant drag is placed on said drum when said drum is rotated, allowing said drum to be free wheeling with respect to said motor; said drum, said motor and the directly driving structure connecting said motor to said drum forming a winch system; and supplemental braking system means associated with the cable for retarding the movement of the cable, when desired, independent of said hydraulic motor means and under the control of the operator, when said drum is free wheeling with respect to said hydraulic motor; said supplemental braking system means comprises a mechanical braking system which acts on said winch system and includes a disc element having peripheral edge portions fixedly mounted on said shaft for common rotation with said drum and said shaft, and at least one caliper brake element having hydraulic actuation means, said caliper brake element fixedly mounted with respect to said winch base, through which caliper brake element said peripheral edge portions of said disc element passes, the hydraulic actuation of said caliper brake element onto said disc element braking said drum under the control of the operator; and a shaft on which said drum is fixedly mounted for rotation, said motor being directly connected to said shaft for rotating said drum; and wherein said supplemental braking system means further includes:

a disc element fixedly mounted on said shaft for common rotation with said drum and said shaft;

a second, supplemental winch system for a second cable, likewise including a winch drum on which the second cable is wound;

a winch drum base upon which said drum for the second cable is mounted, the mounting of said drum on said base allowing said drum to rotate with respect to said base;

hydraulic motor means connected to said drum for said second cable for directly driving and rotating in two alternative directions of rotation said drum to wind up and play out said second cable, depending upon the direction of rotation, said motor having a neutral disposition in which no significant drag is placed on said drum when said drum is rotated, allowing said drum to be free wheeling with respect to said motor; said drum, said motor and the directly driving structure connecting said motor to said drum forming operative elements of said second winch system; the axes of rotation of said hoist drum and said supplemental drum being substantially spaced from one another in a longitudinal direction; and supplemental braking system means associated with said second cable for retarding movement of said second cable, when desired, independent of said hydraulic motor means and under the control of the operator, when said drum is free wheeling with respect to said hydraulic motor.

2. The backhoe conversion system of claim 1, wherein there is further included:

a second, but spring actuated, caliper brake element fixedly mounted with respect to said winch base, through which said second caliper brake element the peripheral edge portions of said disc element also passes, said caliper brake element normally being held open under hydraulic system pressure against the action of the spring, the spring actuation of said caliper brake element onto said disc element braking said drum automatically in the event of hydraulic system failure.

3. The backhoe conversion system of claim 1, wherein:

said boom is a box boom having a top side; and said hoist winch drum is mounted directly on said box boom by means of said drum base.

4. The backhoe conversion system of claim 3, wherein:

said hoist winch drum base is mounted on the top side of said box boom intermediate of said foot connection and said hoist cylinder connection in front of said operator, allowing the operator to directly view the operation of said winch.

5. The backhoe conversion system of claim 3, wherein:

said boom is at least forty feet in length.

6. The backhoe conversion system of claim 5, wherein:

said boom is about fifty feet in length.

7. The backhoe conversion system of claim 1, wherein said supplemental braking system means includes:

a disc element fixedly mounted on said shaft for common rotation with said drum and said shaft, and at least one hydraulically actuated caliper brake element fixedly mounted with respect to said winch base, through which caliper brake element the peripheral edge portions of said disc element passes, the hydraulic actuation of said caliper brake element onto said disc element braking said drum under the control of the operator.

8. An hydraulically powered winching system for use in conjunction with a crane-type boom, which winching system controls a cable connected to a crane-type work implement on the cable, such a work implement being for example, a dragline bucket, lift hook, clamshell, or pile driver, comprising:

a winch drum on which the cable is wound;

a winch drum base upon which said drum is mounted, the mounting of said drum on said base allowing said drum to rotate with respect to said base;

hydraulic motor means connected to said drum for directly driving and rotating in two alternative directions of rotation said drum to wind up and play out the cable, depending upon the direction of rotation, said motor having a neutral disposition in which no significant drag is placed on said drum when said drum is rotated, allowing said drum to be free wheeling with respect to said motor; said drum, said motor and the directly driving structure connecting said motor to said drum forming a winch system; and supplemental braking system means associated with the cable for retarding the movement of the cable, when desired, independent of said hydraulic motor means and under the control of the operator, when said drum is free wheeling with respect to said hydraulic motor, said supplemental braking system means comprising a mechanical braking system which acts on said winch system, said supplemental braking system means including a disc element fixedly mounted on said shaft for common rotation with said drum and said shaft, and at least one hydraulically actuated caliper brake element fixedly mounted with respect to said winch base, through which caliper brake element peripheral edge portions of said disc element passes, the hydraulic actuation of said caliper brake element onto said disc element braking said drum under the control of the operator; and a second, but spring actuated, caliper brake element fixedly mounted with respect to said winch base, through which said second caliper brake element the peripheral edge portions of said disc element also passes, said caliper brake element normally being held open under hydraulic system pressure against the action of the spring, the spring actuation of said caliper brake element onto said disc element braking said drum automatically in the event of hydraulic system failure.

* * * * *